US006007440A

United States Patent [19]

Bender et al.

[11] Patent Number: 6,007,440

[45] Date of Patent: Dec. 28, 1999

[54] LAMINATED BALL BAT

[76] Inventors: Donald A. Bender, 2236 Arborcrest, Moscow, Id. 83843; Joe M. Sample, 16615 Mt. Spokane Park Dr., Mead, Wash. 99021

[21] Appl. No.: 09/050,230

[22] Filed: Mar. 27, 1998

[51] Int. Cl.[6] ..... A63B 59/06

[52] U.S. Cl. ..... 473/564

[58] Field of Search ..... 473/564–568, 473/519, 520

[56] References Cited

U.S. PATENT DOCUMENTS

| | | | |
|---|---|---|---|
| 1,450,646 | 4/1923 | Sadenwater | 473/564 |
| 1,706,680 | 3/1929 | Smith | 473/564 |
| 4,331,330 | 5/1982 | Worst | 273/72 R |
| 4,714,251 | 12/1987 | Cook | 473/564 |
| 5,284,332 | 2/1994 | Di Tullio | 273/72 R |
| 5,460,369 | 10/1995 | Baum | 273/72 R |
| 5,490,669 | 2/1996 | Smart | 273/72 R |
| 5,620,179 | 4/1997 | Mackay, Jr. | 473/564 |

*Primary Examiner*—Mark S. Graham
*Attorney, Agent, or Firm*—David S Thompson

[57] ABSTRACT

A ball bat typically used in playing the game of baseball or softball is constructed of an inner layer bounded by first and second outer layers. The inner layer typically contains four inner lamina bonded together, while the first and second outer layers typically contain a single outer lamina. The inner laminas from the medial portion of the barrel of the bat, as well as the handle portion. The outer laminas form lateral portions of the barrel of the bat, and are gently tapered toward the handle of the bat. The thickness and relative position of each lamina is related to the results of non-destructive testing of the wood forming that lamina.

1 Claim, 1 Drawing Sheet

FIG. 1
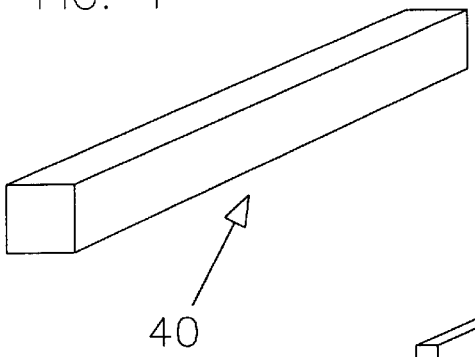
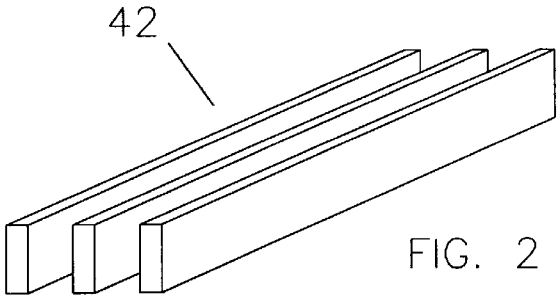
FIG. 2
FIG. 4
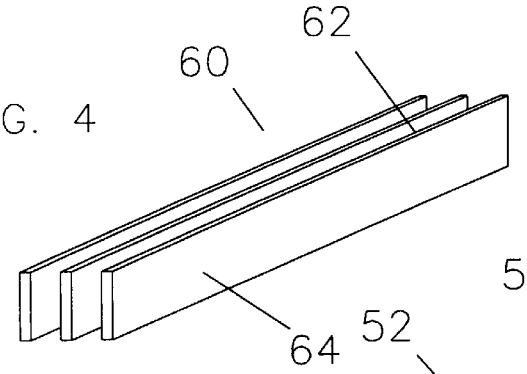
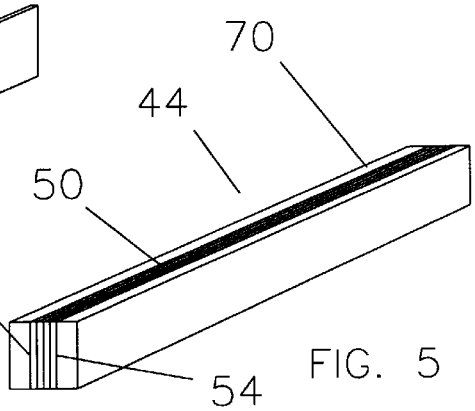
FIG. 5
FIG. 6
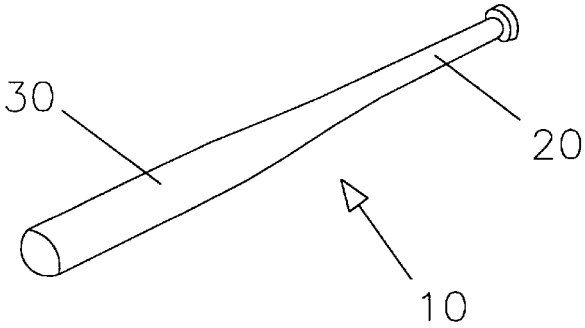
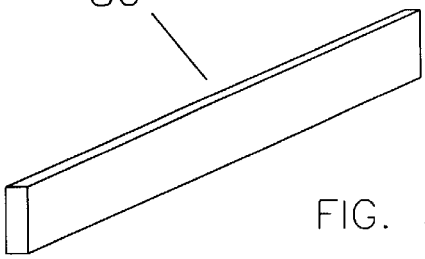
FIG. 3

LAMINATED BALL BAT

CROSS-REFERENCES

There are no applications related to this application filed in this or any foreign country.

BACKGROUND

Ball bats made out of glued laminations are known, such as that disclosed by U.S. Pat. No. 5,490,669. Such bats provide a number of advantages, including particularly increased strength resulting in part from the 180 degree rotation of adjacent plies. Such rotation causes the wood grain in adjacent plies to be substantially mirror images. As a result, the wood throughout the bat is more uniform, thereby decreasing the likelihood of a weak spot, which tends to result in a stronger bat.

Additionally, as a result of the cuts made to separate the plies, the "inside" of the wood is revealed. This can result in the observation of weak spots, allowing replacement with stronger wood. However, known laminated bats have not addressed the issue of nondestructive testing of each of the lamina used to make the bat As a result, the use of substandard lamina is possible. As a result, it is the case that known laminated bats are constructed of individual lamina arranged in locations within the bat that have stress levels that are incompatible with that particular lamina's strength level.

As seen above, the use of glued lamina in bat construction generally results in a stronger bat. However, since known laminated bats have used lamina having a uniform thickness, the resulting increase in strength is uniform throughout the bat, rather than being particularly directed to those areas of the bat that are more likely to break. This is because the specific area of breakage in most bats is an area generally located between the ball player's grip and the impact location of the ball, i.e. in a region between the handle and barrel. This implies that to decrease the likelihood of a bat breaking, certain "weak-link" areas need to be stronger, while other areas of existing bats are already unlikely to break Known laminated bats have not fully addressed the issues of selectively strengthening the weaker areas of a bat.

SUMMARY

The present invention is directed to an apparatus that satisfies the above needs. A novel ball bat and method of manufacture that includes the use of glued laminations is provided wherein non-destructive tests are performed on each lamina used in the construction, and also includes a test of the entire finished bat. Laminas of different thicknesses allows a targeted increase in the strength of the weaker areas of the bat without adding undue cost to the construction.

A preferred version of the laminated ball bat includes a handle end and a barrel end, and further includes:

(A) An inner layer has opposed first and second elongate inner layer surfaces and is cut from one or more initial laminas having ends spaced lengthwise and grain running lengthwise between the first and second ends of the initial lamina. In a preferred embodiment, the inner layer includes:

(a) At least two inner laminas bonded together, each of the at least two lamina having opposed first and second elongate inner lamina surfaces. In a typical application, the inner layer provides four inner laminas bonded together, having an aggregate thickness of about one inch.

(B) First and second outer layers are carried by the first and second elongate inner layer surfaces, respectively. In general, the thicknesses at the thickest points of the inner layer and first and second outer layers are all approximately equal. The first and second outer layers should be cut from initial laminas having first and second ends spaced lengthwise and grain running lengthwise between the first and second ends.

(C) In the preferred embodiment of the invention, non-destructive testing graded the initial laminas used to form the inner layer as stronger than the initial laminas used to form the outer layer. The non-destructive testing may include testing of the modulus of elasticity, specific gravity, damping ratio, visual inspection and the ultrasonic stress wave propagation time, among other tests.

A preferred version of the method of making the ball bat of the apparatus portion of the invention, includes the steps of:

(A) Cutting a number of initial lamina from initial blocks of wood.

(B) Grading each of the initial lamina for density.

(C) Segregating the initial lamina, whereby the higher density initial laminas are earmarked as candidates for possible use in the inner layer and the lower density initial laminas are earmarked for use in the outer layer.

(D) Cutting the initial lamina candidates for use in the inner layer into inner lamina, typically 0.33 inches thick, and planing those inner lamina to the preferred thickness, typically 0.25 inches.

(E) Non-destructively testing each of the inner lamina to determine one or more of the following, including the modulus of elasticity, specific gravity and damping ratio.

(F) Grading each of the inner lamina on a pass-or-fail basis using the results of the non-destructive testing, and a corresponding assigned numerical value.

(G) Assembling an inner layer by bonding together a plurality of passing inner lamina. The inner layer therefore has the same length and width as each inner lamina, but a thickness equal to the aggregate thickness of all of the inner laminas bonded together.

(H) Planing lower density initial laminas to a precise thickness, thereby forming outer laminas.

(I) Attaching at least one of the outer laminas to either side the inner layer, thereby forming a laminated billet.

(J) Turning the laminated billet on a lathe or similar machine, thereby forming and contouring the barrel and handle portions of a ball bat.

It is therefore a primary advantage of the present invention to provide a novel ball bat and method of manufacture that includes the use of glued laminations, including an inner layer having opposed elongate surfaces bonded to first and second outer layers, the inner layer forming the bat's handle and the center portion of the bat's barrel, and where the inner layer is typically formed of wood of a superior grade and strength to that of the outer layer, and particularly having a superior modulus of elasticity.

Another advantage of the present invention is to provide a novel ball bat and method of manufacture that includes the use of glued laminations, wherein an inner layer is formed of a plurality of thinner inner laminas and each outer layers is typically formed from a single thicker outer lamina, thereby focusing the strength improvement in the handle and area between the handle and barrel that is most likely to break.

Another advantage of the present invention is to provide a novel ball bat and method of manufacture that includes the use of glued laminations, wherein the initial laminas to be used in the inner layer are cut into thinner inner lamina which are then individually graded by non-destructive testing to determine their suitability for use, thereby resulting in an inner layer having substantial strength improvement A still further advantage of the present invention is to provide a novel ball bat and method of manufacture that includes the step of a static bending test of the completed ball bat to determine the modulus of elasticity and overall quality of the final ball bat.

DRAWINGS

These and other features, aspects, and advantages of the present invention will become better understood with regard to the following description, appended claims, and accompanying drawings where:

FIG. 1 is an isometric view of an initial block of wood, suitable for use in making a ball bat;

FIG. 2 is an isometric view of three initial lamina, having been cut from the initial block of wood;

FIG. 3 is an isometric view of an outer lamina, having been formed from an initial lamina by planing its surfaces to exact dimensional values;

FIG. 4 is an isometric view of three inner lamina having been cut from an initial lamina, but not yet having been planed to exact dimensional values;

FIG. 5 is an isometric view of the laminated billet, having an inner layer formed of four inner lamina and having first and second outer layers, each outer layer having a single outer lamina; and FIG. 6 is an isometric view of a laminated ball bat, having been turned from the laminated billet of FIG. 5.

DESCRIPTION

Referring in generally to FIGS. 1–5, a ball bat 10 having a structure consistent with construction in accordance with the method and structure of the invention is seen. The ball bat is suitable for use in playing the game of baseball or softball. The ball bat is constructed of an inner layer 50 bounded by first and second outer layers 70. The inner layer typically contains four inner lamina 60 bonded together, while the first and second outer layers typically contain a single outer lamina 80. The inner laminas 60 form the handle 20 and the medial portion of the barrel of the bat. The outer laminas 80 form lateral portions of the barrel 30 of the bat, and are gently tapered toward the handle of the bat. The thickness and relative position of each lamina is related to the results of non-destructive testing of the wood forming that lamina.

In a preferred method of construction, an initial block of wood 40 is cut into initial laminas 42 having a size of approximately 38" (in length) by 3" (in width) by approximately 1" (in thickness). The preferred wood to be used is a select grade of northern white ash.

The length of the initial wood laminas 42 must be selected to be somewhat greater than the length of the bat to be manufactured. The width must be greater than or equal to the diameter of the widest point of the barrel of the bat to be manufactured. The thickness should be selected to be slightly greater than or equal to the thickness of the outer laminas 80. In a preferred embodiment, the outer laminas may be ⅞ inch. As a result, the thickness of the initial laminas should be approximately 1 inch. The thickness of the outer laminas will be reduced somewhat by planing, and later by the lathe in later steps in the manufacturing process, as will be seen.

Each of the initial laminas is then graded according to some indicator of quality, such as density. Another indicator of quality that could alternatively be used is a measurement of the modulus of elasticity.

Having determined the density or other indicator of quality of each individual initial lamina pieces, the initial lamina are then segregated into two groups. A first group, having relatively lower density or other indicator of quality, will be segregated for use in the construction of the lateral portions of the bat's barrel, and will be referred to as outer lamina. A second group, having relatively higher density or other indicator of quality, will be segregated for use in the construction of the bat's handle and the central areas of the bat's barrel, and will be referred to as inner lamina. In a preferred version of the invention, wood having a density of less than 44 pounds per cubic foot is put into the first group, while wood having a density of greater than 44 pounds per cubic foot is put into the second group, although this target density can be adjusted, as desired.

The higher density initial lamina, having been segregated for use in the construction of the handle and central portion of the barrel, should then be cut again, thereby creating a number of inner lamina 60. The cutting process typically reduces the thicknesses of the inner lamina to approximately 0.30 inches. Typically, where each of the initial laminas are 1" in thickness, three inner laminas may be cut from each initial lamina. Having cut three inner laminas 60 from one initial lamina, the inner laminas are then planed to a thickness of 0.25 inches in a preferred embodiment.

In a preferred embodiment of the invention, four inner lamina 60 are used in the construction of the inner layer 50, which forms the handle and inner barrel portion of the bat. Where four inner lamina are used, each typically has a thickness of 0.25 inches. However, a greater or lesser number of inner laminas, each having a greater or lesser thickness could be substituted. In a preferred embodiment, the total thickness of the inner layer 50, which includes of all of the inner lamina 60 used in the construction of the handle and central barrel portion of the ball bat, is approximately 1.0 inch. In general, use of a greater number of inner lamina will result in each lamina being thinner.

In the preferred embodiment of the invention, each individual inner lamina 60 is then mechanically graded to determine quality. More particularly, in the preferred version of the invention, numerical values for three criteria are obtained, including: (1) the modulus of elasticity; (2) the density; and (3) the damping ratio. In an alternative embodiment, one or more of the criteria may be evaluated.

The modulus of elasticity is a fundamental measure of the resiliency of the wood, and it also is correlated to its strength. The density of wood is correlated to wood strength and stiffness, while the damping ratio is another indicator of wood quality.

In the preferred embodiment, the grading process for determining the modulus of elasticity, density, sonic propagation time and damping ratio involves the use of an automated non-destructive testing system, such as the Metriguard model 2600FX machine used in conjunction with the Metriguard 340 Transverse Vibration E-Computer. Both machines are made by Metriguard, Inc., of P.O. Box 399, Pullman, Wash. 99163.

Using the measured values for the modulus of elasticity, the density, the damping ratio, and ultrasonic stress wave propagation time, an estimate of the overall relative strength of each lamina is then calculated, and the lamination grade is output automatically. The grading process is typically evaluated in a pass or fail manner, which will result in the elimination of some inner lamina which do not meet quality control standards.

Inner lamina 60 are then selected from among those passing the testing for construction of the inner layer 50, which will form the ball bat's handle and an inner portion of the barrel portion of the bat. The selection process typically involves picking four 0.25 inch thick inner lamina. Adjacent first and second elongate inner lamina surfaces 62, 64 of consecutive selected inner lamina 60 are then bonded together by means of an adhesive, typically using a vise during the drying process, thereby forming the inner layer 50.

An outer layer 70 is then attached to the first and to the second elongate inner layer surfaces 52, 54 of the inner layer 50. In a preferred embodiment, each outer layer 70 includes a single outer lamina 80. In an alternative embodiment, the outer layer 70 may be formed from two or more outer lamina 80 bonded together. The outer lamina 80 are formed by planing an initial lamina 42, earlier segregated into the first group for use in the lateral portions of the bat's barrel, from a starting thickness of 1 inch to a finished thickness ⅞ inches.

The inner layer 50, together with outer layers 70 bonded to the first and second elongate inner layer surfaces 52, 54, form a laminated billet 44, typically having a length of approximately 38" and a 3" width and a 3" thickness (due to the cumulative thicknesses of the inner and outer laminas).

The laminated billet 44 is then turned on a lathe in a manner that contours the bat to form a handle, barrel and transition between the two. The manner in which a bat may be formed from a laminated billet is known and described in U.S. Pat. No. 5,490,669 issued Feb. 13, 1996 to Merlin L. Smart, which is hereby incorporated in its entirety by reference.

The ball bat is then subjected to a static bending test. A static bending test determines the stiffness of the entire finished ball bat in a non-destructive manner. A static bending test may be performed by a machine such as the Model 440 Static Bending Tester, by Metriguard, Inc., of P.O. Box 399, Pullman, Wash. 99163. The static bending test provides a laboratory measurement of flatwise bending modulus of elasticity (E) of the completed ball bat. The output of this test is used in a pass or fail manner to grade the ball bats as to whether they were adequately manufactured with respect to a quality assurance program.

The previously described versions of the present invention have many advantages, including a primary advantage of providing a novel ball bat and method of manufacture that includes the use of glued laminations, including an inner layer having opposed elongate surfaces bonded to first and second outer layers, the inner layer forming the bat's handle and the center portion of the bat's barrel, and where the inner layer is typically formed of wood of a superior grade and strength to that of the outer layer, and particularly having a superior modulus of elasticity.

Another advantage of the present invention is to provide a novel ball bat and method of manufacture that includes the use of glued laminations, wherein an inner layer is formed of a plurality of thinner inner laminas and each outer layers is typically formed from a single thicker outer lamina, thereby strengthening the handle and area between the handle and barrel that is most likely to break.

Another advantage of the present invention is to provide a novel ball bat and method of manufacture that includes the use of glued laminations, wherein the initial laminas to be used in the inner layer are cut into thinner inner lamina which are then individually graded by non-destructive testing to determine their suitability for use, thereby resulting in an inner layer having substantial strength.

A still further advantage of the present invention is to provide a novel ball bat and method of manufacture that includes the step of a static bending test of the completed ball bat to determine the modulus of elasticity and overall quality of the ball bat The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, the thickness and number of the inner and outer laminas in the inner and outer layers is somewhat arbitrary, and could be altered while still keeping within the scope of the invention, which includes the use of thinner inner lamina in the handle and central barrel portions of the bat and thicker outer lamina used in the outer barrel portions. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A laminated ball bat having a handle end and a barrel end, the laminated ball bat comprising:

(A) an inner layer having opposed first and second elongate inner layer surfaces, the inner layer cut from a first initial lamina having first and second ends spaced lengthwise with grain running lengthwise between the first and second ends, the inner layer comprising:

(a) four inner laminas bonded together, each of the four lamina having a thickness of approximately 0.25 inches, and each of the four lamina having passed a first pass or fail grading process for the modulus of elasticity, density and damping ratio, and each of the four lamina having opposed first and second elongate inner lamina surfaces;

(B) first and second outer layers having opposed first and second elongate outer layer surfaces, the first and second outer layers carried by the first and second elongate inner layer surfaces, respectively, the first and second outer layers cut from second initial laminas having passed a second pass or fail grading process, the second initial laminas also having first and second ends spaced lengthwise with grain running lengthwise between the first and second ends; and (C) wherein the first initial laminas used to form the inner layer are stronger than the second initial laminas used to form the outer layer, as determined by non-destructive testing methods.

* * * * *